US011580835B2

(12) United States Patent
Nguyen et al.

(10) Patent No.: US 11,580,835 B2
(45) Date of Patent: Feb. 14, 2023

(54) METHOD, DEVICE AND SYSTEM FOR THE SIMULATION OF THE PRESENCE OF HUMANS

(71) Applicant: Mitipi AG, Fribourg (CH)

(72) Inventors: Le Kim Khanh Nguyen, Allschwil (CH); Jakob Gabriel Cevc, Zürich (CH); Laura Kristina Schilliger, Zürich (CH); Julian Stefan Stylianou, Winterthur (CH)

(73) Assignee: Mitipi AG, Fribourg (CH)

( * ) Notice: Subject to any disclaimer, the term of this patent is extended or adjusted under 35 U.S.C. 154(b) by 203 days.

(21) Appl. No.: 16/959,635

(22) PCT Filed: Jan. 4, 2019

(86) PCT No.: PCT/EP2019/050130
§ 371 (c)(1),
(2) Date: Jul. 1, 2020

(87) PCT Pub. No.: WO2019/134952
PCT Pub. Date: Jul. 11, 2019

(65) Prior Publication Data

US 2020/0372775 A1 Nov. 26, 2020

(30) Foreign Application Priority Data

Jan. 5, 2018 (CH) ..... 00006/18

(51) Int. Cl.
*G08B 15/00* (2006.01)
*G08B 3/10* (2006.01)
*G08B 5/36* (2006.01)

(52) U.S. Cl.
CPC ..... *G08B 15/002* (2013.01); *G08B 3/10* (2013.01); *G08B 5/36* (2013.01); *G08B 15/001* (2013.01)

(58) Field of Classification Search
CPC ..... G08B 15/002; G08B 3/10; G08B 5/36; G08B 15/001; G08B 15/00; H05B 47/16
See application file for complete search history.

(56) References Cited

U.S. PATENT DOCUMENTS 4,970,489 A * 11/1990 Jenkins ..... G08B 15/002 340/555
6,377,858 B1 4/2002 Koeppe
(Continued)

FOREIGN PATENT DOCUMENTS

WO 2017/207333 A1 12/2017

OTHER PUBLICATIONS

International Search Report dated Jan. 31, 2019 for PCT/EP2019/050130 filed Jan. 4, 2019.
(Continued)

*Primary Examiner* — John A Tweel, Jr.
(74) *Attorney, Agent, or Firm* — Paul D. Bianco; Katharine Davis Wong; Fleit Intellectual Property Law

(57) ABSTRACT

A method, device and system for simulating the presence of humans includes the method steps of defining activity attributes as input data and defining user preferences as input data. As an output, a time sequence for simulated activities is generated, while the method, device and system should provide an exceedingly realistic simulation of the presence of humans for any application where occupancy simulation is advantageous. This is reached in that user preferences are matched with attributes of activity respectively in that a control unit of a device or within a system is configured to match user preferences with attributes of activity for the generation of the sequence list for simulated activities.

18 Claims, 4 Drawing Sheets

(56) References Cited

U.S. PATENT DOCUMENTS

| | | | | |
|---|---|---|---|---|
| 7,719,435 | B2 * | 5/2010 | Readier | G08B 15/002 340/815.45 |
| 10,970,984 | B2 * | 4/2021 | Magielse | H05B 47/155 |
| 2009/0109051 | A1 | 4/2009 | Bodden et al. | |
| 2015/0160636 | A1 | 6/2015 | McCarthy, III et al. | |
| 2016/0163169 | A1 | 6/2016 | Gerdes | |
| 2018/0211503 | A1 | 7/2018 | Baliga et al. | |

OTHER PUBLICATIONS

Written Opinion for PCT/EP2019/050130 filed Jan. 4, 2019.
International Preliminary Report dated Jul. 7, 2020 with Written Opinion for PCT/EP2019/050130 filed Jan. 4, 2019.

* cited by examiner

METHOD, DEVICE AND SYSTEM FOR THE SIMULATION OF THE PRESENCE OF HUMANS

TECHNICAL FIELD

The present invention relates to a method, device and system for the simulation of the presence of humans, in particular for securing a building or dwelling or premises against theft, burglary and vandalism, and suitable for providing an occupancy simulation according to the preamble of claim 1.

STATE OF THE ART

It is current state of the art that several security systems exist for securing a building or dwelling.

Deterring vandalism and burglary are important for property owners. Vandalism and property theft can often be deterred merely by having the premises occupied or watched by security personnel. Making a building appear to be occupied is also an effective deterrent to burglary, vandalism and other trespass. When away from home, many residents use lighting control systems such as timers and/or carrier control units, to turn lights on and off so as to simulate occupancy of a building.

Security systems are of particular interest wherein the systems are suitable for simulating occupancy of a building or dwelling.

Several devices are in known in the art, e.g. from the document US 2009/0109051 A1, which are suitable for simulating occupancy of a building by simulating light that is output from an operational TV screen.

Moreover, document U.S. Pat. No. 6,377,858 B1 discloses a security system for securing a building or dwelling by occupancy simulation in that appliances and devices are used in the building or dwelling. The security system of U.S. Pat. No. 6,377,858 B1 is able to learn actual usage pattern over an extended length of time. Such security system includes a learn mode, wherein an intelligent control system records and stores the on/off events of controlled devices in the building or dwelling. In a run mode, the intelligent control system replays the on/off events thus reflecting the usage patterns of the resident. The controlled devices which are controlled by the intelligent control systems may be lights, audio equipment, and appliances. Such system has the disadvantage that this system cannot be used instantly, since a usage pattern has to be created over a longer time period in order to have a realistic simulation.

Further document US 2016/0163169 A1 discloses a system configured to emit a presence or occupancy media signal in order to simulate presence in a building. The system includes a noise processing module configured to evaluate a noise signal picked up by a microphone. When a noise processing unit detects a predefined noise signal event in the picked up noise signal, a control module generates a media signal in response to the detected predefined noise signal event. Such system has the disadvantage that it only works as a reaction to a noise.

There is a constant need to further improve such security systems suitable for providing an exceedingly, more realistic simulation of occupancy of a building or dwelling. Simulation of occupancy or, in general, the simulation of the presence of humans regarding any possible applications needs to be further improved constantly.

DESCRIPTION OF THE INVENTION

The object of the present invention is to provide an improved method, device and system for securing a building or dwelling or premises, and suitable for providing a presence respectively occupancy simulation, wherein such method, device and system provides an exceedingly realistic simulation of occupancy of a building or dwelling or premise.

Next to the occupancy simulation of a building or dwelling or premises, the simulation of the presence of humans regarding further applications is possible such as, for example, the usage in the army as a fake decoration of occupancy.

Therefore, it is a further object of the present invention to provide, more generally, an improved method, device and system for an exceedingly realistic simulation of the presence of humans for any application where occupancy simulation is advantageous. Such a realistic simulation will make the owners of the device according to the present invention safer and more comfortable.

According to the present invention, the method comprises a method step, wherein user preferences are matched with attributes of activity for the generation of a time sequence for simulated activities. Such matching is realised by a matcher algorithm which is further described in detail below.

More preferably, the method includes a further method step, wherein external factor data are further matched with the user preferences and the attributes of activity.

Compared to the known device of U.S. Pat. No. 6,377,858 B1 only having a learning function, such method advantageously allows an instant customization towards an exceedingly realistic simulation of the presence of humans.

Within the meaning of the present invention, such method should be applicable to any device, or interacting devices within a system which is or are respectively able to play an outputted time sequence of audio and/or visual activities. In other words, such time sequence may be understood as an ongoing simulation stream.

According to a further aspect of the present invention, the control unit of a device is configured to match user preferences with attributes of activity. Within the meaning of the present invention, the control unit may be a processing unit capable for processing algorithms and capable for telling input and output devices how to respond to a program's instructions.

The device according to the present invention preferably comprises a storage unit configured to store user preferences, activity attributes, activity content, and external factor data. According to a preferred embodiment, the storage unit may be further configured to store a playback history of activities. Activity content can be defined as a content behind an activity to be played (visual or audio), e.g. a WAVE file (".wav") for an audio simulation.

In a preferred embodiment, the device according to the present invention is configured to play sophisticated visual simulations such as shadow simulations, and/or audio simulations such as simulating the presence of pets. More preferably, the device according to the present invention is further configured to play combined visual and audio simulations such as television simulation.

Within the meaning of the present invention, activities may include data on the visual output respectively on the audio output. Visual effects may include but are not limited to shadow simulations, television simulation, or turning on/off lights. Audio effects may include but are not limited to pet noises, sport activities etc.

Within the meaning of the present invention, attributes (in the context of activities) can be defined as preset parameters such as for example the likelihood for certain activities or an illumination threshold.

The term "attributes of activity" means that each activity is tagged with predefined, internal attributes serving as reference to the construction of a sequence of activities. Examples of such internal attributes are illustrated in table 1 below.

Within the meaning of the present invention, user preferences can be defined as predefined, specific audio data input and/or visual data input and/or a time related input from the user, for example, whether he has got an animal, where he lives, which types of activities he prefers, his location and time zone, etc. Time related inputs with respect to user preferences can be understood as e.g. the geographic conditions influencing a time slot for an activity in the generated time sequence of activities.

Such definition of the user preferences advantageously improves the user's confidence that the device according to the present invention generates occupancy or presence simulation that is as realistic as possible.

Preferably, the controlled devices which are controlled by the control unit according to the invention, may be lights or a lighting unit, audio equipment or an audio unit, and appliances.

According to a preferred embodiment of the invention, the device may integrate a lighting unit and an audio unit and further appliances. Alternatively or additionally, the device according to the invention may be configured to interact with lighting units, audio units and/or further appliances outside the device. The integration or interaction with other devices might be done directly or via a server, an application programming interface (API) or other means of communication.

According to a further preferred embodiment of the invention, the control unit of the device may be further configured to further match external factor data with the user preferences and the attributes of activity.

Within the meaning of the present invention, external factor data can be defined as physically measurable data such as weather data, values from an illumination sensor and/or geographic data such as location of the user with its local day time. For example, by combination of the date and geographic location, changes in day length related to the latitude respectively seasons can be adjusted.

Combining the external factor data with the user preferences and the attributes of activity advantageously leads to an improved, more realistic simulation of occupancy of a building or dwelling.

Furthermore, combining physically measurable data with geographic data (defined both as external factor data) can help verifying that the simulation is running correctly respectively in a realistic way. For example, an illumination under a certain threshold measured by the illumination sensor which is implausible by time zone respectively geographic latitude, may be an indication for a dramatic weather change and be verified by consulting weather data.

According to a further aspect of the present invention, a system with several interacting devices is provided comprising a control unit, of physical or virtual nature, which is configured to match user preferences with attributes of activity. Within the meaning of the present invention, such system preferably comprises a plurality of devices executing certain functions and coupled respectively interacting with each other. As an example, the system may include the device according to the invention and/or lighting units and/or audio units and/or further appliances of which integration or interaction might be done directly or via a server, an application programming interface (API) or other means of communication. Preferably, the interacting devices are playing an output time sequence of simulated activities generated by the method according to the present invention.

BRIEF DESCRIPTION OF THE DRAWINGS

A preferred exemplary embodiment of the subject matter of the invention is described below in conjunction with the attached drawings.

DESCRIPTION

Figure 1:
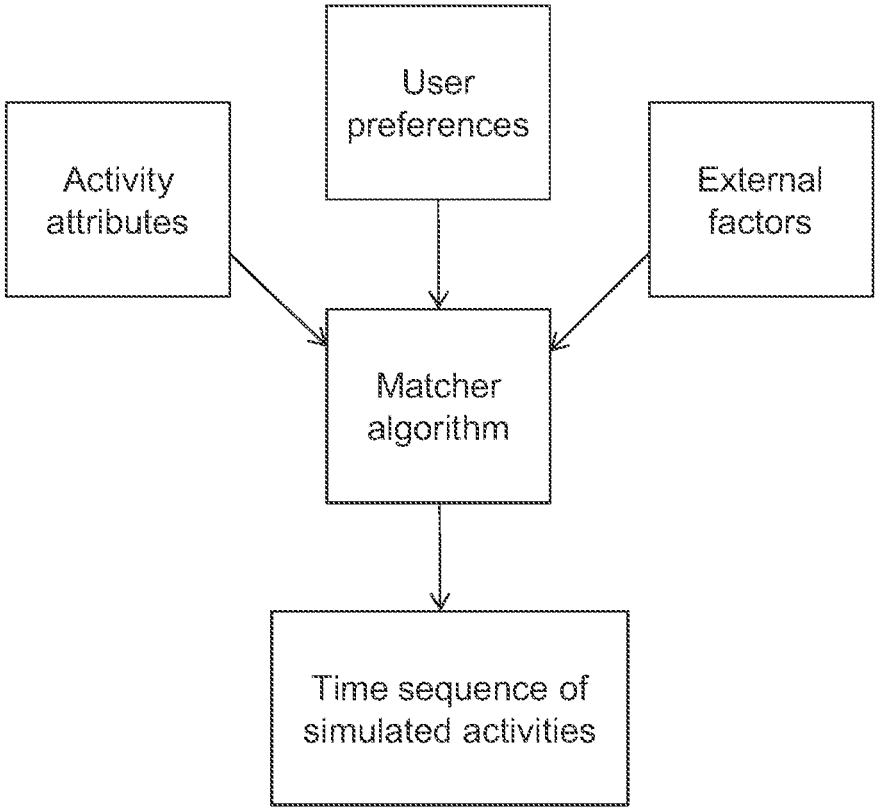
FIG. 1 shows a generalized flowchart of a method of a preferred embodiment of the security device according to the present invention.

FIG. 1 shows a generalized flowchart of a method of a preferred embodiment of the security device according to the present invention.

The method comprises a method step, wherein user preferences are matched with attributes of activity for the generation of a time sequence for simulated activities by means of a dedicated matcher algorithm. Preferably, the method further includes a further method step, wherein external factor data are further matched with the user preferences and the attributes of activity.

Figure 2:
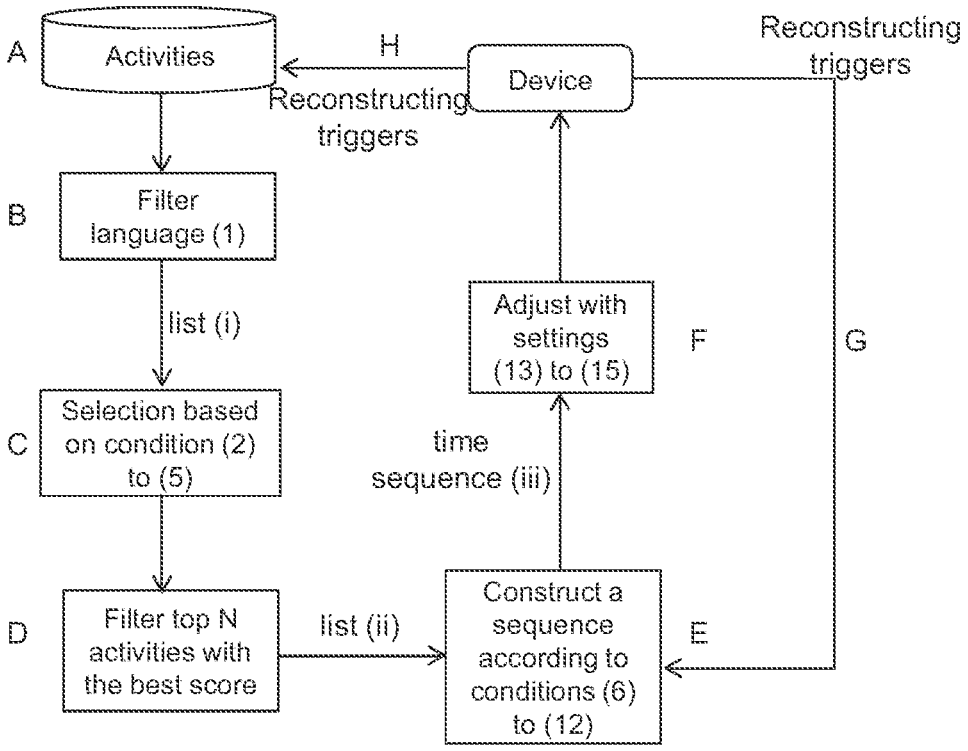
FIG. 2 shows a more detailed flowchart of the method of a preferred embodiment of the security device according to the present invention.

FIG. 2 shows a more detailed flowchart of the method of the preferred embodiment of the security device according to the present invention.

The following table 1 shows examples of activity attribute and user preferences correlated to function of the matcher algorithm:

| No. | Matcher algorithm ($f_i$) | Score ($S_i$) | Activity attributes (on the device side) | User preferences | External data |
|---|---|---|---|---|---|
| 1 | f1 | ∞ | language | language | |
| 2 | f2 | 1 | tags | tags | |
| 3 | f3 | 1 | type | type | |
| 4 | f4 | 1 | environment | environment | |
| 5 | f5 | 1 | room type | room type | |
| 6 | f6 | 1 | time, day of week, likelihood | location | local date, time |
| 7 | f7 | 1 | geographic data | location, time zone | local date, time |
| 8 | f8 | 1 | weather | | weather data |
| 9 | f9 | 1 | composition | | illumination sensor |
| 10 | f10 | 1 | cooldown | | |
| 11 | f11 | 1 | minimum break period | | |
| 12 | f12 | | length | | |
| 13 | N/A | N/A | volume | volume | |
| 14 | N/A | N/A | brightness | brightness level | |
| 15 | N/A | N/A | illumination threshold | | illumination sensor |

As can be seen from the table 1 above, the matcher algorithm of the method of the present invention is able to decide, based on the activity attribute respectively user preference, the processing and prioritizing of the data. The output of the method of the present invention is a time sequence of simulated activities. Moreover, it can be seen that the matcher algorithm may be understood as a plurality of functions $f_i$ which are preferably defined for every condition.

A possible implementation of the method according to the present invention, based e.g. on a score function, can be described as follows:

Step A: providing a database of all potential activities;

Step B: selecting from the database all of the activities matching the selected language of the user, resulting in a first list (i) of activities;

Step C: Adding a weighted score $s_i$ for each of the conditions (2) to (5) according to table 1, and each of the selected activities of the first list (i). In other words, user preferences are matched with activity attributes in this method step.

Step D: Sorting such first list (i) by the score and a number of activities with the best score are selected (filtering), resulting in a second list (ii) of activities;

Step E: Constructing a time sequence of activities (iii) based on the second list (ii) of activities, wherein each activity in the second list (ii) might be repeatedly selected to put on the time sequence (iii). Within the meaning of the present invention, the selection of which activity to put at each time slot of the sequence is evaluated by the conditions specified in (6) to (12) of table 1, in that each satisfied condition contributes a score $s_i$ to the selection of the activity. This selection repeats until the length of the time sequence is filled, i.e. if, for example, a certain maximum time length is reached (e.g. 7 days of absence of the user respectively owner of the device). In other words, preferably, external factor data are further matched with the user preferences and the attributes of activity according to method step E.

Step F: playing sequentially each of the activities in the generated time sequence (iii), being adjusted to the settings respectively conditions as specified from (13) to (15) according to table 1.

Step G: After having finished playing each activity of the time sequence (iii), or by a trigger from external data, the time sequence (iii) of activities may be reconstructed adjusting to any new changes of the conditions (6) to (12).

Step H: Optionally, triggered by changing the user preferences, the method steps A to D may be performed newly, leading to the reconstruction of the sequence (iii) of activities.

The conditions No. (1) to (15) as defined in table 1 are further explained and exemplified as follows:

(1): All activities may be matched by function f1 corresponding to the language set by the user (i.e. user preference).

(2): "tags" may be understood as kind of context of the activity which the user respectively owner of the device likes, for example [DOG, CAT, FAMILY, ANIMAL, . . . ]. Preferably, the dedicated function f2 is defined in way to partly match activity attributes in respect of the user preference depending on the similarities between the kind of context of activities.

(3): "type" may be understood as type of the activity which the user respectively owner of the device likes, for example [ENTERTAINMENT, WORK, CHORES, COOKING, HYGIENE, ANIMAL, SPORT, . . . ]. Preferably, the dedicated function f3 is defined in the way of partly matching (like f2).

(4): "environment" may be understood as the area where the user respectively owner of the device is living and the device is used respectively placed, for example [URBAN, SUB_URBAN, VILLAGE, REMOTE, . . . ]. Preferably, the dedicated function f4 is defined in the way of partly matching. For example, contexts of activities like URBAN can also be matched with user preferences of SUB_URBAN.

(5): "room type" may be understood as the placement of the device within the home of the user respectively owner, for example [BEDROOM, LIVING ROOM, CORRIDOR, KITCHEN, OFFICE, . . . ]. Preferably, the dedicated function f5 is defined in the way of partly matching. For example, attributes of activities of LIVING ROOM can also be matched to user preferences of CORRIDOR.

(6): "time, day of week, likelihood" may be understood as the day and (day) time related probability of occurrence of certain activities and the likelihood of repetition. For example, showering and playing music normally does not happen at night, cooking normally does not happen more than three times per day, or certain activities are more likely to happen on the weekend. Preferably, the dedicated function f6 is defined in the way of partly matching.

(7): "geographic data" may be understood as day and (day) time related occurrence of activities related to the geographic location, i.e. time zone and latitude. For example, the occurrence of visual simulations has to be adjusted with respect to changes in day length related to the latitude and/or seasons. Preferably, the dedicated function f7 is defined in the way of partly matching.

(8): "weather" may be understood as the consultation of weather data. For example, simulation of more visual activities gaining preference on a stormy or overcast day, the impression of presence is maximised. Preferably, the dedicated function f8 is defined in the way of partly matching.

(9): "composition" may be understood as adjusting the output type of the activities for time sequence (iii) creation based on the data of the illumination sensor, for example [VISUAL, AUDIO, BOTH]. As an example, in a dark environment, activities with visual content are preferably selected more frequently than activities only with audio content, since it reflects normal people's behaviour to turn lights on when it is dark. Preferably, the dedicated function f9 is defined in a way to provide the best selection of the composition.

(10): "cooldown" may be understood as preventing the same activity to be scheduled again before its cooldown period is over. For example, people will not take another shower right after just having had a shower. Preferably, the dedicated function f10 is defined in a way not to select the same kind of activity depending on the cooldown period.

(11): "minimum break period" may be understood as having a minimum break period before a next activity is scheduled. For example, people would likely rest some minutes after a shower. Preferably, the dedicated function f11 is defined in a way not to select any activities depending on the minimum break.

(12): "length" may be understood that in case of a temporarily limited simulation time, the activities and schedule of activities will be built in regards to that. For example, if the simulation is scheduled to run for 30 minutes, the algorithm will not start/play a 3 hours activity. Preferably, the dedicated function f12 is defined in a way to select activities fitting to the simulation time.

(13): "volume" may be understood as adjusting the audio volume of the playback according to the preferred volume of the user respectively owner of the device.

(14): "brightness" may be understood as setting the brightness level according to the preferred brightness of the user respectively owner of the device.

(15): "illumination threshold" may be understood as activating the visual part of the playback if the value of the illumination sensor drops below a certain threshold for a certain amount of time disregarding the time of the day.

As a further option, the user can feedback whether the simulated activities are realistic or not with the advantage that the feedbacks will help refine the corresponding user preferences and activity attributes.

Figure 3:
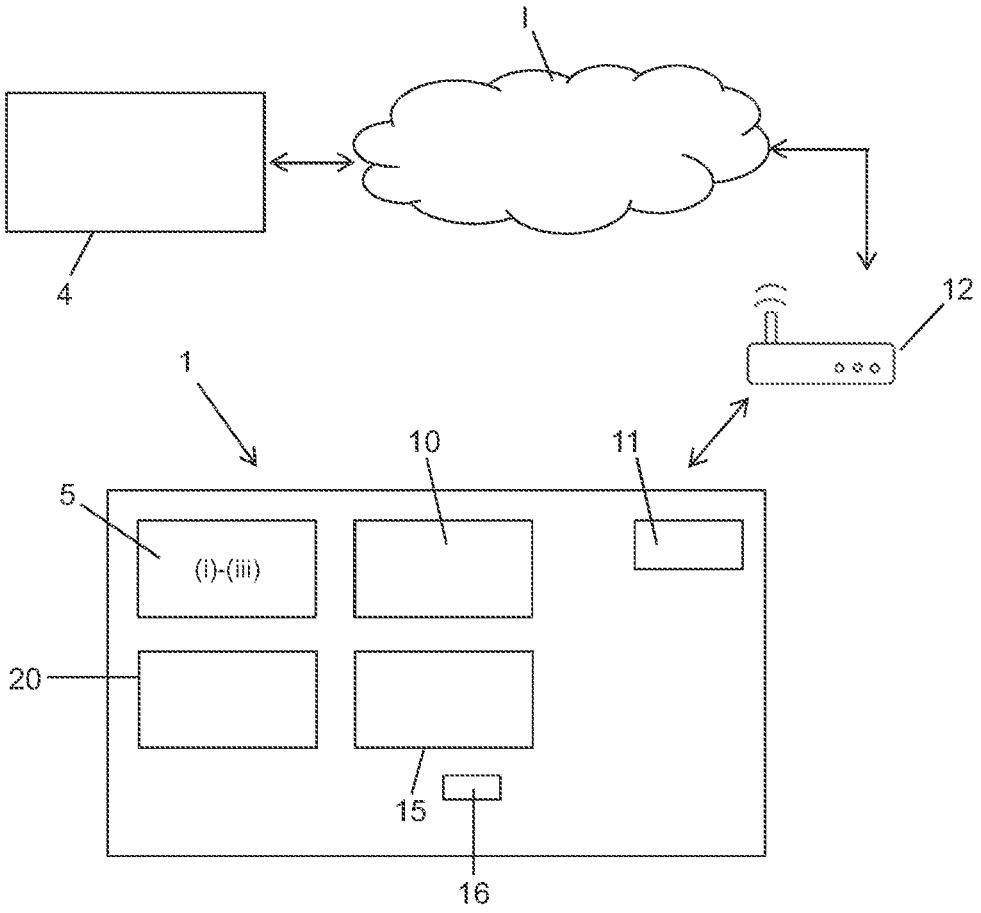
FIG. 3 shows a schematic view of a preferred embodiment of the security device according to the present invention.

FIG. 3 shows a schematic view of a preferred embodiment of the security device 1 according to the present invention, wherein the security device 1 is, in principle, one integrated device capable of fulfilling the method according to the present invention. The security device 1 may comprise a control unit 5, a storage unit 10, a, preferably multi-colour, lighting unit 15 and an audio unit 20. As indicated in FIG. 3, preferably, the control unit 5 of the device 1 is configured and capable of carrying out the whole method according to the present invention, i.e. generating the first list (i), the second list (ii) and the time sequence (iii) of activities. The device may further comprise a Wifi (or other connectivity) module 11 enabling the communication within a wired (i.e. local LAN) or wireless network environment via an Internet router 12 and, thereby, capable e.g. for receiving program updates from a server 4. The storage unit 10 is preferably capable for storing such program updates, activities contents, activities attributes, user preferences, external data etc. Preferably, the control unit 5 respectively lighting unit 15 is coupled functionally with an illumination sensor 16 in order to activate the visual part of the playback if the value of the illumination sensor drops below a certain threshold.

Figure 4:
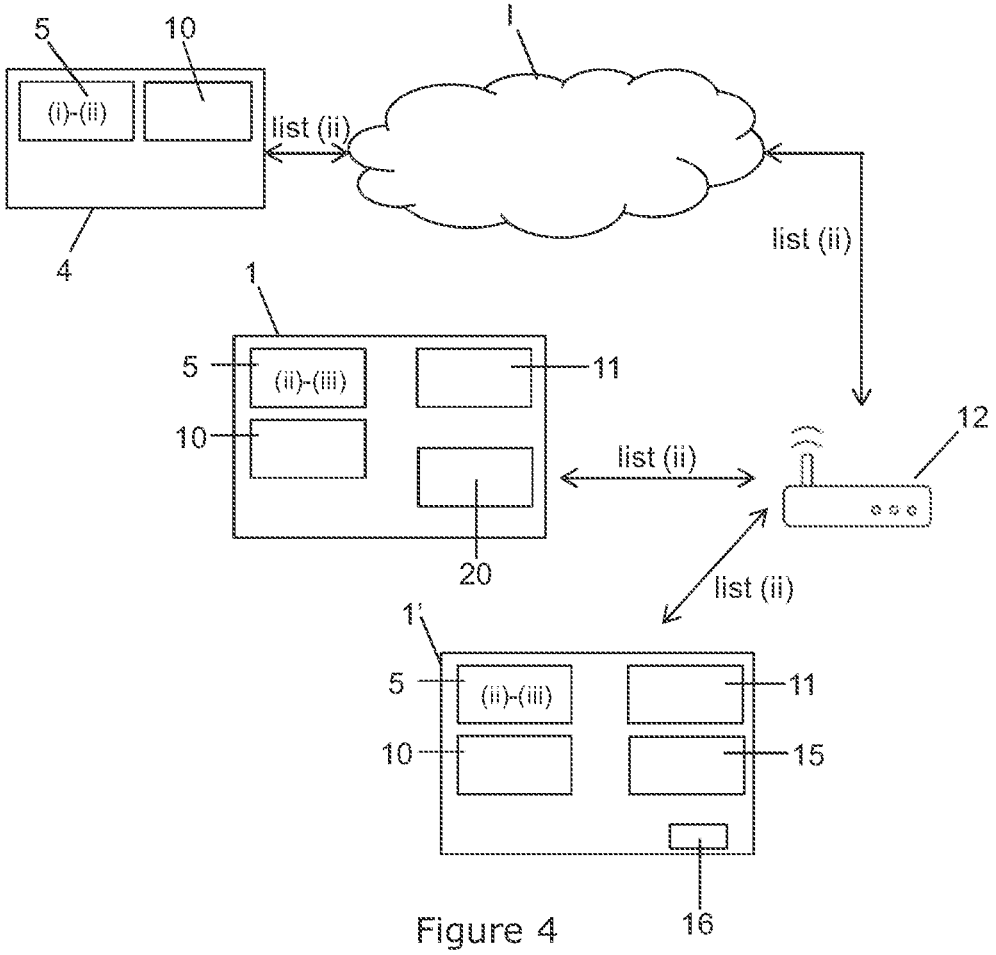
FIG. 4 shows a schematic view of a preferred embodiment the system with multiple devices according to the present invention.

FIG. 4 shows a schematic view of a preferred embodiment the system with multiple devices according to the present invention.

As exemplified in FIG. 4, each unit in the system may be responsible of at least one part of the method. Preferably, the system comprises a server 4 (or multiple servers), wherein the server 4 comprises its own control unit 5 and storage unit 10 and runs a part of or the whole part of the method according to the present invention. As indicated in FIG. 4, the control unit 5 of the server 4 is configured here to run process steps A to D generating the list (i) and list (ii) (see implementation of the method according to FIG. 2). Several devices capable of a visual and/or audio simulation may be running part or the whole of the method, such as the devices 1; 1'. The server 4 may be configured for transmitting the generated list (ii) to the devices 1; 1'.

According to the system as shown in FIG. 4, a server 4 may be part of wired (i.e. local LAN) or a wireless network environment (e.g. a cloud) interacting via the Internet I and an Internet router 12 with the devices 1; 1'. Device 1 may comprise a Wifi module 11 enabling the communication within the wireless network environment, and an audio unit 20.

In one example, the devices 1 and the device 1' further comprises a control unit 5 and a storage unit 10, wherein the control unit 5 is configured and capable of carrying out part of the method according to the present invention, i.e. generating time sequence (iii) of activities based on the received second list (ii).

Device 1' may comprise a Wifi (or other connectivity) module 11 enabling the communication within the wired or wireless network environment, and a, preferably multi colour, lighting unit 15. Preferably, such lighting unit 15 is coupled functionally via the control unit 5 with an illumination sensor 16 in order to activate the visual part of the playback if the value of the illumination sensor 16 drops below a certain threshold.

LIST OF REFERENCE NUMERALS

1; 1' Security device
4 (Cloud) Server
5 Control unit
10 Storage unit
11 Wifi module
12 Internet router
15 (Multi colour) lighting unit
16 Illumination sensor
20 Audio unit
i First list of activities
ii Second list of activities
iii Time sequence of activities
I Internet
$s_t$ Score

The invention claimed is:

1. A method for simulating a presence of humans, the method comprising:

defining activity attributes of simulated activities of a user as input data; and defining user preferences as input data;

wherein as an output, a time sequence for the simulated activities of the user is generated, wherein the user preferences are matched with the activity attributes for generation of the time sequence for the simulated activities, and wherein visual simulations of the simulated activities are played based on data on a visual output included in stored activities content.

2. The method according to claim 1, further comprising matching external factor data with the user preferences and the activity attributes for the generation of the time sequence for the simulated activities.

3. The method according to claim 2, wherein the generated time sequence for the simulated activities is re-constructable based on changes triggered by the external factor data.

4. The method according to claim 3, wherein upon triggering by change of the user preferences, the method steps are performed again, leading to the reconstruction of the time sequence for the simulated activities.

5. A device for implementing the method, for simulating the presence of humans, according to claim 1, the device comprising:

a storage unit for storing activities content, the activity attributes, the user preferences, and external factor data;

at least one of a lighting unit and an audio unit for playing, as an output, the time sequence for the simulated activities; and a control unit, wherein the control unit is configured to match the user preferences with the activity attributes for the generation of the time sequence for simulated activities; and wherein the device is configured to play visual simulations of the simulated activities based on data on a visual output included in the stored activities content.

6. The device according to claim 5, wherein the control unit is configured to further match the external factor data with the user preferences and the activity attributes.

7. A system for implementing the method, for simulating the presence of humans, thereby providing an occupancy simulation for a building or premises, according to claim 1, the system comprising:

a storage unit for storing activities content, the activity attributes, the user preferences, and external data;

at least one of a lighting unit and an audio unit for playing, as an output, a time sequence for the simulated activities; and a control unit, wherein the control unit is configured to match the user preferences with the activity attributes for the generation of the time sequence for simulated activities, and wherein the control unit is configured to play visual simulations of the simulated activities based on data on a visual output included in the stored activities content.

8. The system according to claim 7, wherein the control unit is configured to further match the external factor data with the user preferences and the activity attributes.

9. The method according to claim 1, wherein the visual simulations include shadow simulations.

10. The method according to claim 1, wherein the visual simulations are played when a value of an illumination sensor drops below a predetermined threshold.

11. The device according to claim 5, wherein the visual simulations include shadow simulations.

12. The device according to claim 5, wherein the visual simulations are played when a value of an illumination sensor drops below a predetermined threshold.

13. The system according to claim 7, wherein the visual simulations include shadow simulations.

14. The system according to claim 7, wherein the visual simulations are played when a value of an illumination sensor drops below a predetermined threshold.

15. A method for simulating occupancy of a building or premises, the method comprising:

defining activity attributes of simulated activities of a user of the building or premises as input data;

defining user preferences as input data;

matching the user preferences with the activity attributes;

generating a time sequence for the simulated activities of the user as an output by matching the user preferences with the activity attributes; and playing visual simulations of the simulated activities of the user based on data from visual output stored in activities content.

16. The method according to claim 15, further comprising matching external factor data with the user preferences and the activity attributes for the generation of the time sequence for the simulated activities.

17. A system for implementing the method, for simulating the presence of humans, thereby providing an occupancy simulation for a building or premises, according to claim 15, the system comprising:

a plurality of coupled interacting devices; and at least one communication element, wherein each device of the plurality of coupled interacting devices includes a storage unit for storing the activities content, the activity attributes, the user preferences, and external factor data; at least one of a lighting unit or an audio unit for playing, as an output, the time sequence for the simulated activities; and a control unit, wherein the control unit is configured to match the user preferences with the activity attributes for the generation of the time sequence for simulated activities; and wherein the device is configured to play visual simulations of the simulated activities based on data on a visual output included in the stored activities content.

18. The system according to claim 17, wherein the at least one communication element is at least one of a server and an application programming interface (API).

* * * * *